US005791941A

United States Patent [19]

Wang

[11] Patent Number: 5,791,941

[45] Date of Patent: Aug. 11, 1998

[54] ELECTRONIC CONDUCTOR ASSEMBLING PLUG

[76] Inventor: Lien-Sheng Wang, 8F-2, No. 8, Alley 10, Lane 658, Section 2, Chung Hsing Rd., Chutung, Hsinchu Hsien, Taiwan

[21] Appl. No.: 715,805

[22] Filed: Sep. 19, 1996

[51] Int. Cl.[6] ..... H01R 33/95

[52] U.S. Cl. ..... 439/622; 439/589

[58] Field of Search ..... 439/587, 589, 439/621, 426

[56] References Cited

U.S. PATENT DOCUMENTS

| | | | |
|---|---|---|---|
| 2,915,737 | 12/1959 | Morse | 439/587 |
| 4,684,914 | 8/1987 | Wu | 439/622 |
| 4,904,976 | 2/1990 | Liaq | 439/622 |
| 5,176,539 | 1/1993 | Liu | 439/622 |
| 5,267,880 | 12/1993 | Tamm | 439/622 |
| 5,451,173 | 9/1995 | Mai | 439/622 |
| 5,618,206 | 4/1997 | Sawada et al. | 439/587 |

*Primary Examiner*—Gary F. Paumen
*Assistant Examiner*—Katrina Davis
*Attorney, Agent, or Firm*—Beveridge, DeGrandi, Weilacher & Young, L.L.P.

[57] ABSTRACT

A fuse plug having waterproofing chips for sealing.

15 Claims, 6 Drawing Sheets

ELECTRONIC CONDUCTOR ASSEMBLING PLUG

FIELD OF THE INVENTION

This invention is related to an electricity connecting plug which is water proof and has a connecting spot between the conductor and the power cable which does not require welding.

BACKGROUND OF THE INVENTION

In our daily living, we cannot live without electronic appliances and when we need to use one of them, we just plug it in to the power source, which is very convenient. However, over a period of time of actual use, because of variations in the temperature or humidity or because of improper use, it is easy for the plug to have a short circuit or electricity leakage which can cause a fire and big damage. Therefore, one of the most important criteria for safety testing in America in order to avoid unnecessary and dangerous accidents and to increase safety is to make the plugs waterproof.

SUMMARY OF THE INVENTION

The main object of this present invention is to provide an electric plug where there is a butterfly plate on the two sides of the negative conductor of the plug and by the crease and the pressure of the butterfly plate, it covers a non-insulated portion of a power wire and fixes it in place without welding the connection.

The second object of the present invention is to provide a water proof plug where there is a convex slot on the two sides of the end of the inner plug and there is a pliant water proof chip inside the plug and by this, water going into the plug which may cause electricity leakage or short circuit is prevented.

Another object of the present invention is to provide a water proof plug where there is a water proof piece inserted in the conductor opening at the end of the bottom of the outer shell of the plug and by this, water is prevented from going through.

BRIEF DESCRIPTION OF THE DRAWINGS AND THEIR COMPONENT NUMBERS

(A) The Drawings

For these reasons and in order to provide a further understanding, the structure and characteristics of the present invention are described in detail with reference to the accompanying drawings in which.

(B) The Component Numbers

| | | | |
|---|---|---|---|
| 10 | outer shell | 231 | wing-shaped structure |
| 11 | opening | 24 | fuse |
| 12 | fuse cover | 241 | fuse slot |
| 13 | conductor opening | 242 | convex slot |
| 131 | convex slot | 25 | conductor reed |
| 14 | convex slot | 26 | cable separation board |
| 15 | concave piece | 27 | concave shaped slot |
| 20 | inner plug | 28 | conductor opening |
| 201 | link plug | 30 | power cable |
| 202 | link plug hole | 31 | water proof chip |
| 21 | conductor slot | 311 | cone shaped slot |
| 22 | positive conductor | 32 | water proof piece |
| 23 | negative conductor | 321 | cable hole |

DETAILED DESCRIPTION OF THE INVENTION

Figure 1:
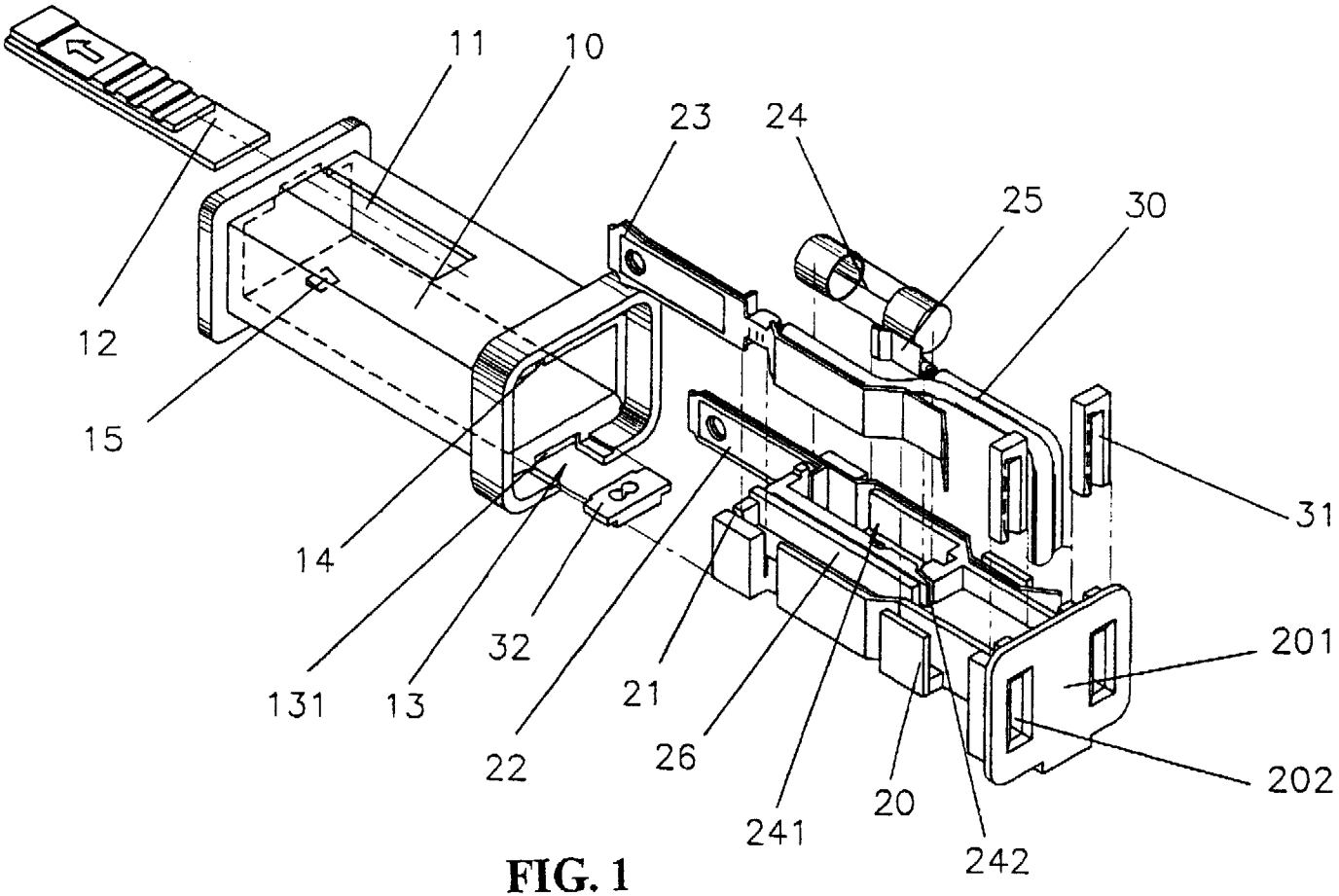
FIG. 1 is a 3-dimensional analytic diagram of the structure.

FIG. 1 is a structural 3-dimensional analytic diagram of this invention. It includes one outer shell 10 and an inner plug 20 and the outer shell 10 is seen as one body with the flat surface pipe. On top is an opening 11 for a fuse cover 12 to be pushed in and be sealed. On the bottom, a conductor opening 13 is provided in order for a power cable 30 to be inserted. In the center of the inside of the bottom of plug 10, a concave piece 15 for engaging an inserted inner plug 20 is disposed.

Figure 2:
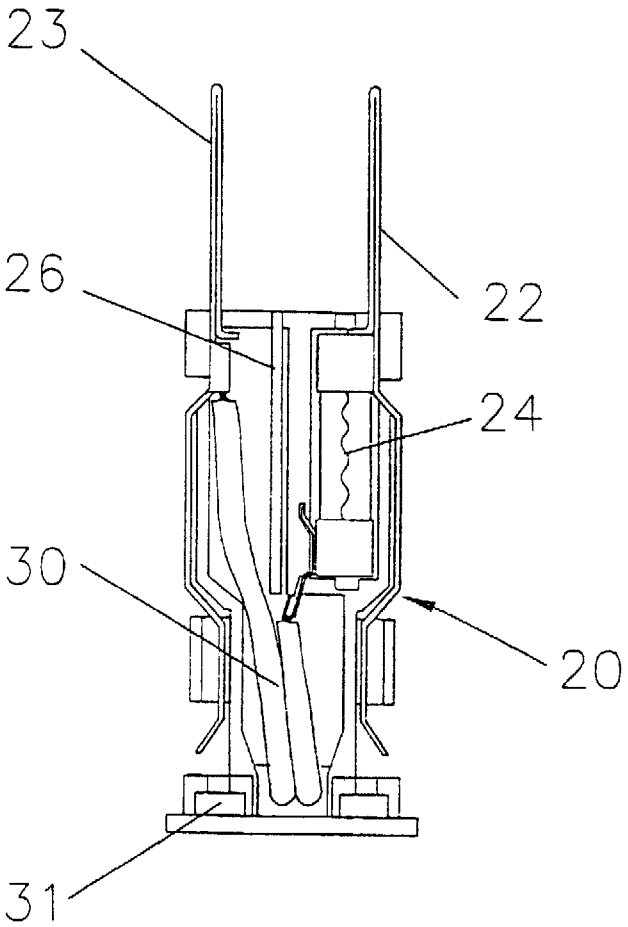
FIG. 2 is a structural indication diagram of the inner plug.

FIG. 2 is the structural indication diagram of the inner plug 20. The inner plug 20 is seen as one body without the shell on top of it. It can be fitted into the outer shell 10 and the two sides have an opening and the opening is extended to the two sides of the inner plug 20 and forms two conductor slots 21.

Figures 3A, 3B, 3C:
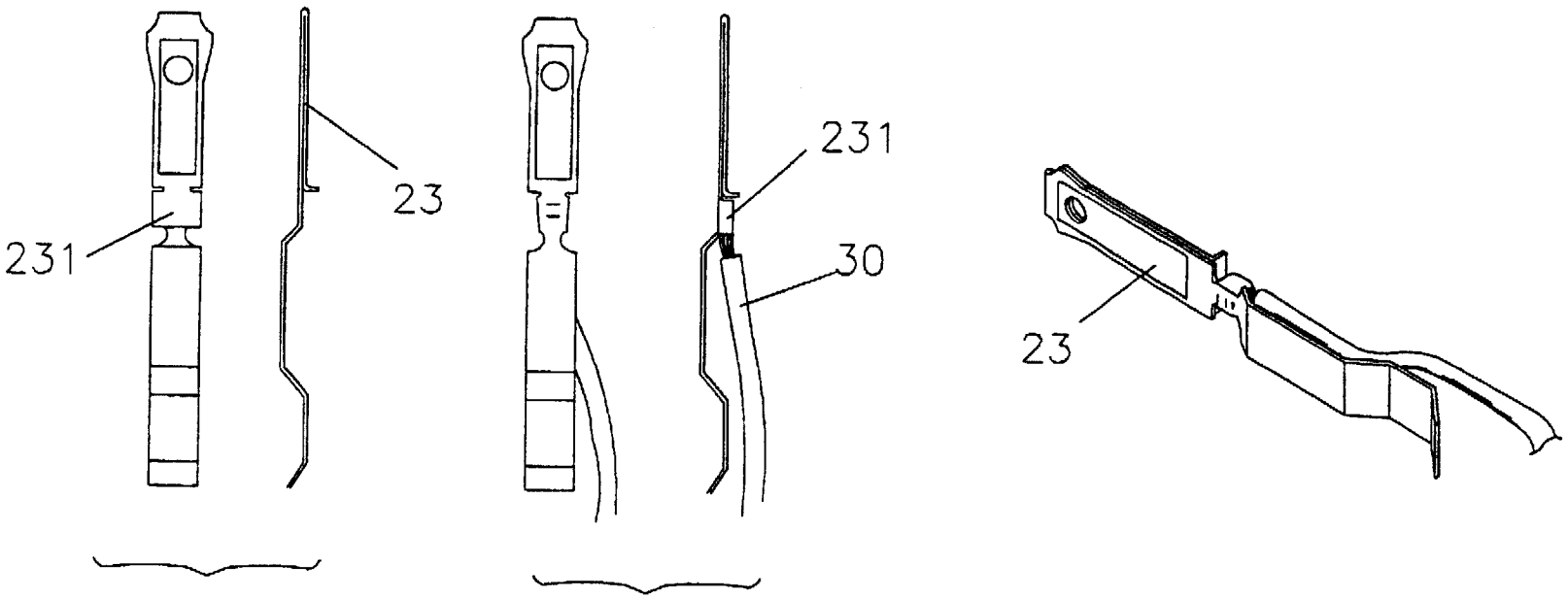
FIGS. 3A–3C are structural indication diagrams of the negative conductor.

The two conductor slots 21 are positioned to receive the positive and negative conductors 22 and 23 respectively and the structure is seen as one body. The end of the positive conductor 22 is positioned to touch the side of the fuse 24 and the negative conductor 23 is positioned in the opening of the two sides and has a creased wing shaped portion 231 and by this wing shape, it can cover and secure the power cable 30. One side of the power cable 30 is cut and separated and wrapped with the wrapping material and forming two non-insulated wires. One of the non-insulated wires is positioned on the wing shaped structure 231 of the negative conductor 23 and by a pressurized procedure, it is fixed to the negative conductor 23 (as indicated in FIG. 3). When the non-insulated wire and the negative conductor 23 are connected in this manner, the connection does not need to be secured by an electric welding process.

The other non-insulated wire is connected to a conductor reed 25. The conductor reed 25 is inserted into the side of the fuse slot 241 inside the convex slot 242 and by this it secures the wire and also forms an electrical circuit when connected with the fuse 24. In order to avoid the two non-insulated wires from causing a short circuit because of a touching point, the two are separated by a cable separation board 26. On top of the cable separation board 26 is a slightly raised side of inner plug 20 which is received within convex slot 14 at the inner side of the outer shell 10. This allows the inner plug 20 and the outer shell 10 to be tightly sealed together and at the same time the function of cable separation in order to avoid a high voltage short circuit is provided to further protect the user.

Figures 4, 4A:
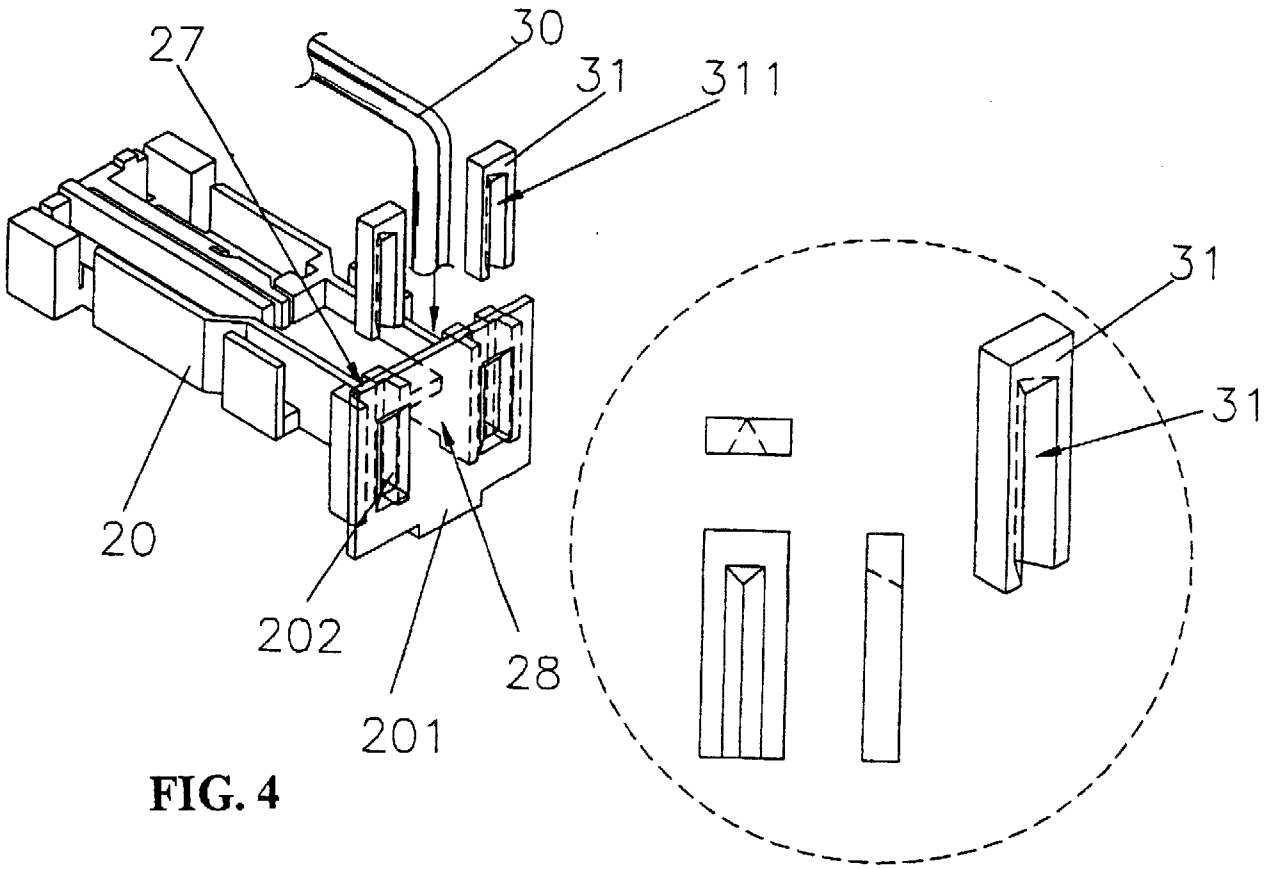
FIGS. 4 and 4A are structural indication diagrams of the water proof chip.

FIGS. 4 and 4A are structural indication diagrams of the water proof chip, which also is seen in FIG. 1. The bottom side of the inner plug 20 has a conductor opening at the outer shell 10 which is the same as the conductor opening 28. The bottom side has a linked plug 201 and two plug holes 202 in the linked plug 201 each having a concave shaped slot 27. Inside each concave shaped slot 27, a water proof chip 31 is inserted. The water proof chip 31 is positioned parallel to the plug hole 202 in which there is a vertical angle or cone shaped slot 311 (shown best in FIG. 4*a*). When there is another plug that is plugged into it, the cone shaped slot 311 resiliently opens and by this tight fit, water is prevented from going through the plug hole 202. At the same time, because the water proof chip 31 is pliant, when the plug is pulled out, even though the cone shaped slot 311 is pierced therethrough, the design of the cone shape still allows the sides to recover to the sealed position, and therefore it becomes water proof.

Figure 5A:
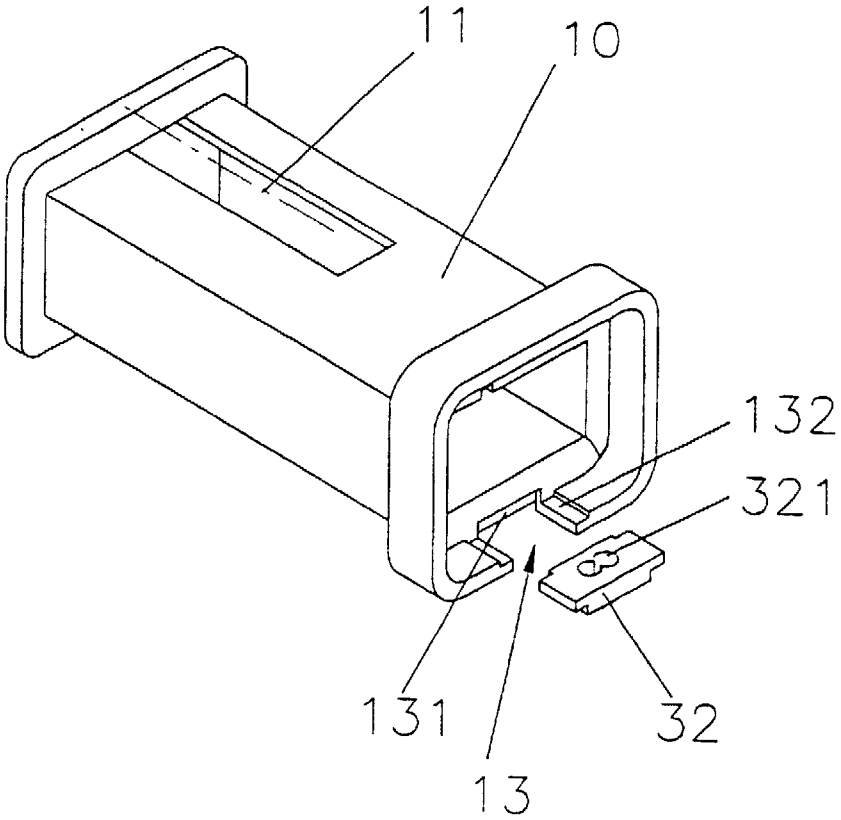
FIGS. 5A and 5B are structural indication diagrams of the water proof piece.
Figure 5B:
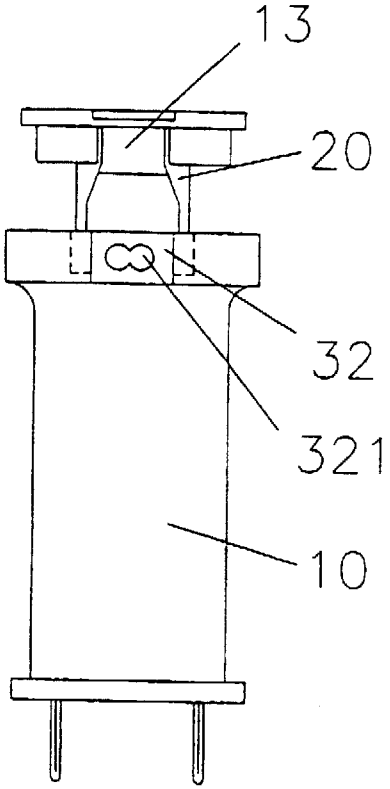

FIGS. 5A and 5B are structural indication diagrams of the water proof piece. There is a conductor opening 13 at the bottom of the outer shell 10, and the face of the inside of the outer shell 10 of the electronic conductor opening 13 is a convex slot 131. The two sides have a step slot 132 whereby this can allow a water proof piece 32 to be inserted and fixed. On the proper place of the water proof piece 32 is a cable hole 321 where a power cable 30 can be inserted. After the power cable 30 is installed on the inner plug 20 and at the same time fixed to the outer shell 10, the water proof piece 32 is fixed tightly on the step slot 132 at the bottom of the outer shell 10 and at the same time the power cable 30 will be pulled steady and by this it will prevent water from going through the conductor opening 13 or going through the power cable 30 that is being shown and thus becomes water proof.

Figure 6:
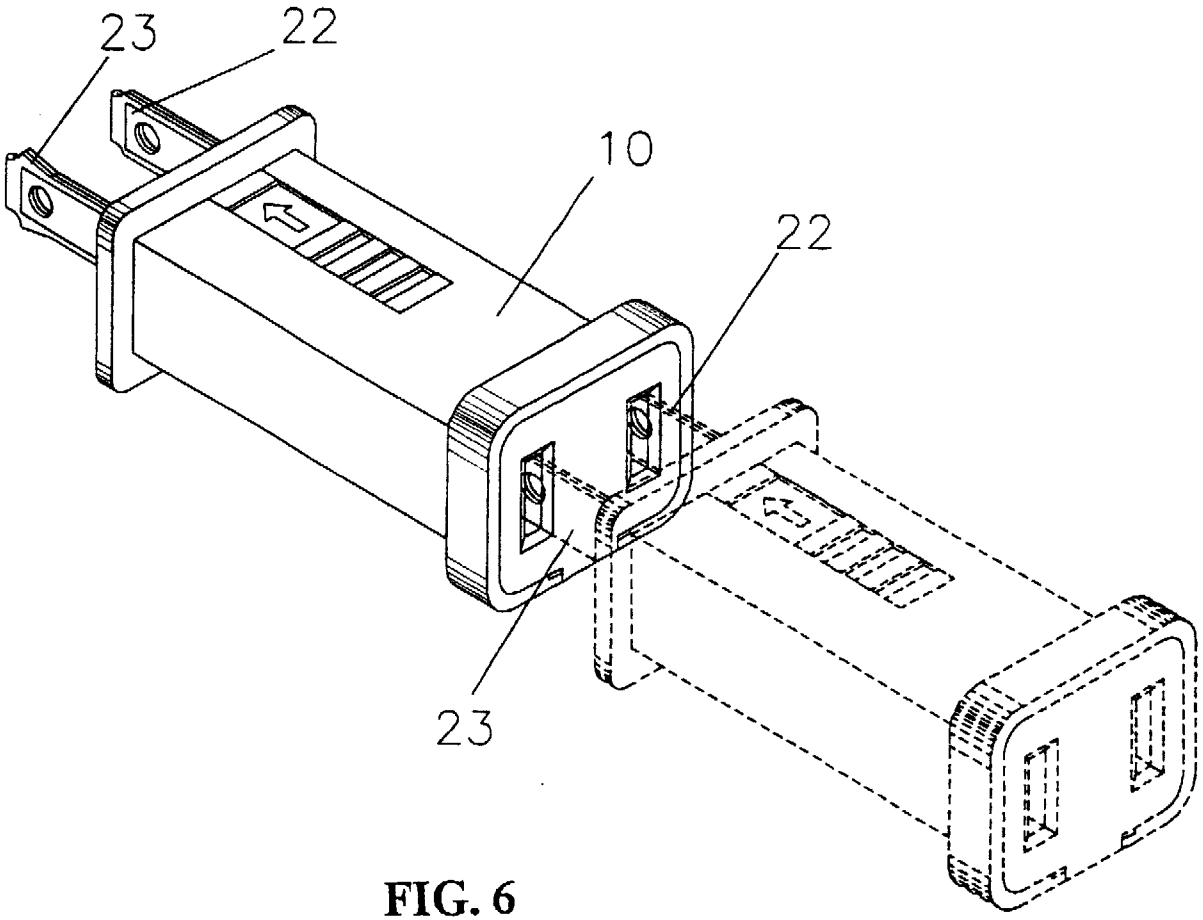
FIG. 6 is an exterior indication diagram of the invention.

FIG. 6 is an exterior indication diagram. The plug structure of this invention is assembled, and as indicated in FIG. 1, the two conductors 22 and 23 are inserted into the conductor slots 21. The bottom of the two conductors 22 and 23 is extended close to the bottom of the inner plug 20 and by this it can allow another plug to be plugged in and have power, to complete the assembly.

In combination of the above explanation, it can be sure that the plug of the present invention is practical and creative, novel and non-obvious.

The above explanation however is only that of a preferred embodiment, and thus the invention cannot be limited to that shown in the diagrams. Various changes or modifications made to the invention are still included in the scope of the appended claims which define the present invention.

I claims:

1. A connecting plug assembly, comprising:

an outer shell portion defining a plug chamber having at least one open end and having a power cord opening defined therethrough;

an inner plug portion received in said plug chamber, said inner plug portion having an end face and defining a power cord path for receiving a power cord therein, said end face being disposed at said open end of said plug chamber and said end face having a pair of plug holes defined therethrough for receiving a pair of plug conductors, said power cord path being in communication with said power cord opening of said plug chamber; and sealing means for resiliently sealing said plug holes and for preventing fluid communication therethrough.

2. The connecting plug assembly defined in claim 1, wherein:

said power cord opening is essentially the same shape and size as said power cord.

3. The connecting plug assembly defined by claim 2, wherein:

said plug chamber comprises a resilient first portion engaged with a second portion, said power cord opening being defined through said resilient first portion of said plug chamber.

4. The connecting plug assembly defined by claim 1, wherein:

said sealing means includes a pair of holding slots supported by said end face and a pair of water proof chip members respectively disposed in said holding slots, said holding slots being positioned proximal to said plug holes.

5. The connecting plug assembly defined by claim 4, wherein:

said water proof chip members each comprise a resilient member having a thick portion and a thin portion, said thin portion being penetrable by a plug conductor wherein said thin portion is biased tightly about said plug conductor.

6. The connecting plug assembly defined by claim 5, wherein:

said inner plug portion further defines a positive conductor seat, a fuse seat, a conductor reed member slot and a negative conductor seat.

7. The connecting plug assembly defined by claim 6, further comprising:

a positive conductor disposed in said positive conductor seat, a fuse disposed in said fuse seat, a conductor reed member disposed in said conductor reed member slot and a negative conductor disposed in said negative conductor seat, wherein, said positive conductor has a first portion thereof extending outside said plug chamber and a second portion positioned proximal to one of said plug holes, said negative conductor has a first portion thereof extending outside said plug chamber and a second portion positioned proximal to one of said plug holes, and said conductor reed member contacts said fuse and said fuse contacts said positive conductor.

8. The connecting plug assembly defined by claim 7, further comprising:

a power cord having first and second leads, said first lead being connected with said negative conductor, said second lead being connected with said conductor reed member.

9. The connecting plug assembly defined by claim 7, wherein:

said outer shell member includes a recess and said inner plug member includes a protrusion, said protrusion being received in said recess.

10. The connecting plug assembly defined by claim 9, wherein:

said outer shell member further includes a concave piece member engaging said inner plug member.

11. The connecting plug assembly defined by claim 1, wherein:

said inner plug portion further defines a positive conductor seat, a fuse seat, a conductor reed member slot and a negative conductor seat.

12. The connecting plug assembly defined by claim 11, further comprising:

a positive conductor disposed in said positive conductor seat, a fuse disposed in said fuse seat, a conductor reed member disposed in said conductor reed member slot and a negative conductor disposed in said negative conductor seat, wherein, said positive conductor has a first portion thereof extending outside said plug chamber and a second portion positioned proximal to one of said plug holes, said negative conductor has a first portion thereof extending outside said plug chamber and a second portion positioned proximal to one of said plug holes, and said conductor reed member contacts said fuse and said fuse contacts said positive conductor.

13. The connecting plug assembly defined by claim 12, further comprising:

a power cord having first and second leads, said first lead being connected with said negative conductor, said second lead being connected with said conductor reed member.

14. The connecting plug assembly defined by claim 13, wherein:

said outer shell member includes a recess and said inner plug member includes a protrusion, said protrusion being received in said recess.

15. The connecting plug assembly defined by claim 14, wherein:

said outer shell member further includes a concave piece member engaging said inner plug member.

* * * * *